US010400427B2

(12) United States Patent
Jee

(10) Patent No.: US 10,400,427 B2
(45) Date of Patent: Sep. 3, 2019

(54) FLEX PIN

(71) Applicant: SRJ, Inc., Schaumburg, IL (US)

(72) Inventor: Woo Young Jee, Inverness, IL (US)

(73) Assignee: SRJ, Inc., Schaumburg, IL (US)

( * ) Notice: Subject to any disclaimer, the term of this patent is extended or adjusted under 35 U.S.C. 154(b) by 0 days.

(21) Appl. No.: 15/982,456

(22) Filed: May 17, 2018

(65) Prior Publication Data

US 2018/0347155 A1 Dec. 6, 2018

Related U.S. Application Data

(60) Provisional application No. 62/513,259, filed on May 31, 2017.

(51) Int. Cl.
*E02F 9/28* (2006.01)

(52) U.S. Cl.
CPC ..... *E02F 9/2841* (2013.01)

(58) Field of Classification Search
CPC ..... E02F 9/2833; E02F 9/2841; E02F 9/2858
See application file for complete search history.

(56) References Cited

U.S. PATENT DOCUMENTS

| | | | | |
|---|---|---|---|---|
| 2,798,403 | A | 7/1957 | Launder | |
| 2,991,569 | A | 7/1961 | Launder | |
| 3,437,003 | A | 4/1969 | Rhoads | |
| 3,468,210 | A | 9/1969 | Watts | |
| 3,520,224 | A | 7/1970 | Ensley et al. | |
| 3,704,753 | A | 12/1972 | Hasforth et al. | |
| 3,879,867 | A | 4/1975 | Ericson et al. | |
| 4,077,729 | A * | 3/1978 | Schwappach | E02F 9/2841 403/379.4 |
| 4,129,934 | A | 12/1978 | Gettman | |
| 4,155,665 | A * | 5/1979 | Kaarlela | E02F 9/2841 403/355 |
| 4,192,089 | A * | 3/1980 | Schwappach | E02F 9/2841 37/457 |
| 4,579,494 | A | 4/1986 | Bierwith | |
| 4,823,487 | A | 4/1989 | Robinson | |
| 5,394,629 | A | 3/1995 | Ruvang et al. | |

(Continued)

FOREIGN PATENT DOCUMENTS

| | | | |
|---|---|---|---|
| CA | 2538123 C | 3/2005 | |
| DE | 2639989 C2 * | 4/1982 | E02F 9/2841 |

(Continued)

OTHER PUBLICATIONS

Part Specification List for the "230 Series Deltawing Tooth System," 909 230DFP, retrieved from http://www.colemanequip.com/specsheets/parts/909_230DFP.pdf, Aug. 22, 2015, 1 pp.

(Continued)

*Primary Examiner* — Matthew Troutman
(74) *Attorney, Agent, or Firm* — Shumaker & Sieffert, P.A.

(57) ABSTRACT

A flex pin includes a compressible member positioned between first and second rigid members configured to be installed in a tooth and shank assembly. The first rigid member includes a locking recess defined by a front wall, a locking major surface, and a rear portion including a back wall and back gradient. At least one of the first or second rigid members includes a bonding recess configured to receive a portion of the compressible member.

21 Claims, 6 Drawing Sheets

(56) References Cited

U.S. PATENT DOCUMENTS

| | | | | |
|---|---|---|---|---|
| 5,469,648 | A | 11/1995 | Jones et al. | |
| 5,617,655 | A | 4/1997 | Launder et al. | |
| 5,802,752 | A | 9/1998 | Quarfordt | |
| 6,030,143 | A | 2/2000 | Kreitzberg | |
| 6,385,871 | B1 | 5/2002 | Quarfordt | |
| 9,840,829 | B2 * | 12/2017 | Jee | B22D 25/02 |
| 2005/0050775 | A1 * | 3/2005 | Clendenning | E02F 9/2841 37/452 |
| 2008/0201997 | A1 | 8/2008 | Armstrong | |
| 2008/0256832 | A1 * | 10/2008 | Esti | E02F 9/2841 37/456 |
| 2017/0152647 | A1 * | 6/2017 | Jee | B22D 25/02 |

FOREIGN PATENT DOCUMENTS

| | | | | |
|---|---|---|---|---|
| EP | 0531603 | A1 * | 3/1993 | E02F 9/2825 |
| EP | 0531603 | A1 | 3/1993 | |
| EP | 2378010 | A2 | 10/2011 | |
| GB | 1332323 | A | 10/1973 | |
| GB | 1549248 | A | 7/1979 | |
| WO | WO-0032881 | A1 * | 6/2000 | E02F 9/2841 |
| WO | 2011088506 | A1 | 7/2011 | |
| WO | 2014186233 | A1 | 11/2014 | |

OTHER PUBLICATIONS

"Ningbo Fancheng Machinery Parts Manufacturer", China Super V Esco Bucket Teeth, retrieved from http://excavator-sparepart.worldinmfg.com/, Sep. 8, 2015, 4 pp.

Everychina, "Ningbo Fancheng Machinery Parts Manufacturer," Combi Bucket Teeth Pins, retrieved from http://excavatorsparepart.sell.everychina.com, Sep. 8, 2015, 2 pp.

"X 330 Bucket Tooth with P330 Flex Pin," x330 hensley bucket tooth, retrieved from Bucket-Teeth.Biz, Sep. 8, 2015, 1 pp.

Prosecution History from U.S. Appl. No. 14/955,398, dated from Apr. 7, 2017 through Nov. 7, 2017, 32 pp.

* cited by examiner

FLEX PIN

This application claims the benefit of U.S. Provisional Application No. 62/513,259 filed May 31, 2017, which is incorporated herein by reference in its entirety.

TECHNICAL FIELD

The disclosure relates to a flex pin.

BACKGROUND

Many earthmoving vehicles (e.g., excavators, skid steer track loaders, multi-terrain track loaders, agricultural vehicles, or the like) may include buckets or blades designed for moving or excavating soil or other materials. In some examples, the buckets or blades of the earthmoving vehicles may include a plurality of teeth positioned along the edge of the bucket or blade designed for assisting with the excavating process. Each tooth may be attached to a shank fixed to the bucket or blade using a flex pin.

SUMMARY

The present disclosure describes example flex pins, which may be used, for example, to secure a tooth and shank assembly for a bucket or blade of an earthmoving vehicle. In addition, the present disclosure describes example methods of using the flex pins and example methods of forming the flex pins.

In some examples, the disclosure describes a flex pin that includes a first rigid member including a first elongated body extending along a central axis of the flex pin from a first forward end to a first back end, the first forward end defining a first tapered tip and the first elongated body defining a first bonding surface and a locking recess. The locking recess extends laterally along the first elongated body between the first forward end and the first back end and includes a major, a forward portion comprising a forward wall adjacent to the first forward end, and a rear portion comprising a back wall extending from the major surface of the locking recess and a back gradient defining a slope that transitions from an end of the back wall to a first outer surface of the first rigid member. The flex pin includes a second rigid member including a second elongated body extending along the central axis from a second forward end to a second back end, the second elongated body defining a second outer surface and a second bonding surface and the second forward end defining a second tapered tip. The flex pin includes a compressible member positioned between the first rigid member and the second rigid member, where at least one of the first bonding surface or the second bonding surface defines a bonding recess configured to receive a portion of the compressible member and the compressible member is connected to the first bonding surface and the second bonding surface.

In some examples, the disclosure describes a method of forming a flex pin, the method including forming a first rigid member, where the first rigid member includes a first elongated body extending along a central axis of the flex pin from a first forward end to a first back end, where the first elongated body defines a first bonding surface and a locking recess, where the locking recess extends laterally along the first elongated body between the first forward end and the first back end. The locking recesses includes a major surface substantially parallel to the central axis, a forward portion including a forward wall adjacent to the first forward end, and a rear portion including a back wall extending from the major surface of the locking recess and a back gradient defining a slope that transitions from an end of the back wall to a first outer surface of the first rigid member, where the first forward end defines a first tapered tip. The method includes forming a second rigid member, where the second rigid member comprises a second elongated body extending along the central axis from a second forward end to a second back end, where the second elongated body defines a second outer surface and a second bonding surface, and where the second forward end defines a second tapered tip. The method includes positioning a compressible member between the first rigid member and the second rigid member, where positioning the compressible member includes positioning a portion of the compressible member into a bonding recess defined by at least one of the first bonding surface or the second bonding surface, where the compressible member is connected to the first bonding surface and the second bonding surface.

The details of one or more examples of the disclosure are set forth in the accompanying drawings and the description below. Other features, objects, and advantages of the disclosure will be apparent from the description and drawings, and from the claims.

DETAILED DESCRIPTION

The present disclosure describes flex pins configured to secure a tooth and shank assembly for a bucket or blade of an earthmoving vehicle. In some examples, the flex pins of the present disclosure may provide an increased resistance against the flex pin becoming unintentionally dislodged from the tooth and shank assembly during operation of the vehicle compared to other designs. While the flex pins of the present disclosure are described below in the reference to a securement device for a tooth and shank assembly of an earthmoving vehicle, the flex pins of the present disclosure may be used for other applications or other devices.

Figure 1:
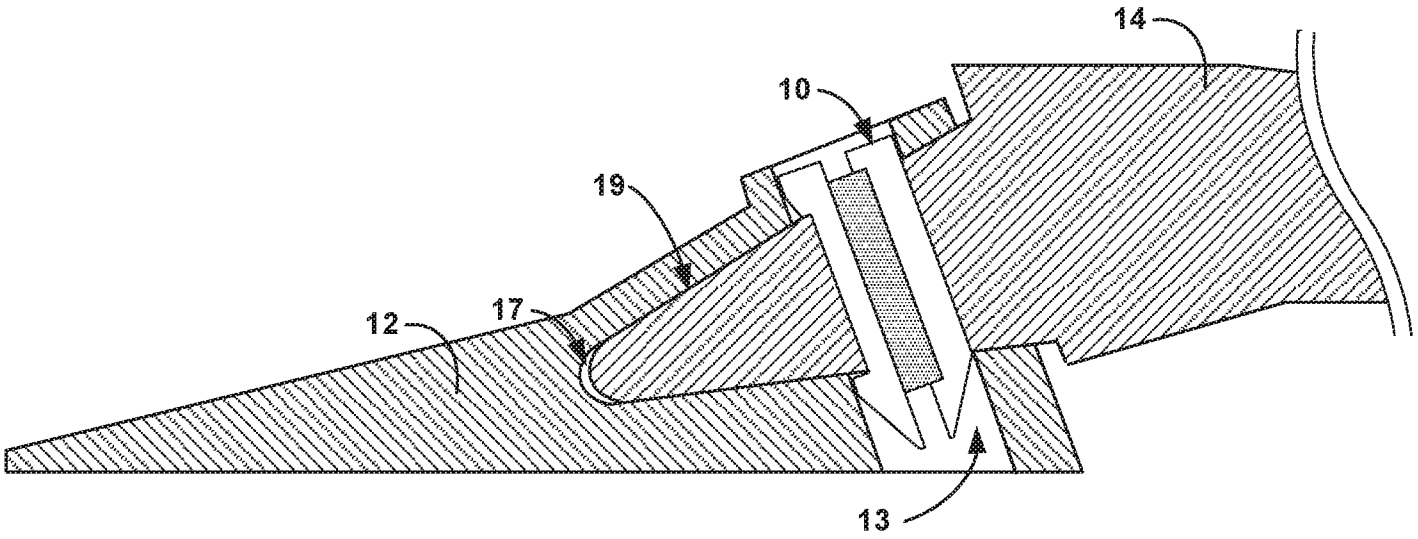
FIG. 1 is a conceptual cross-sectional view schematic of an assembly including an example flex pin that secures a tooth to a corresponding shank of a bucket for an earth moving vehicle.

FIG. 1 is a conceptual cross-sectional view illustrating an example flex pin 10 used to attach a tooth 12 to a corresponding shank 14 of a bucket for an earth moving vehicle (not shown). Tooth 12 may include a replaceable tooth for an earthmoving vehicle including, for example, excavators, skid steer track loaders, backhoes, multi-terrain track loaders, agricultural vehicles, or the like. In some examples tooth 12 may be configured to receive a portion of shank 14. For example, as shown in FIG. 1, tooth 12 may include a cupped section 17 configured to receive a tapered portion 19 of shank 14. Tooth 12 and shank 14 may each include corresponding bore holes 13 that substantially align (e.g., align or overlap enough to permit flex pin 10 to extend through the bore holes 13) when tooth 12 and shank 14 are assembled. Flex pin 10 may be inserted into corresponding bore holes 13 of tooth 12 and shank 14 to help retain and secure tooth 12 to shaft 14 during operation of the vehicle. In some examples, the bore hole 13 of tooth 12 may be slightly larger than the bore hole of shank 14 to allow for a portion of shank 14 to be received in a locking recess of flex pin 10 as describe further below.

In some examples, the earthmoving vehicle may include a bucket assembly including a plurality of shanks (e.g., shank 14) attached to a digging edge of the bucket and respective teeth (e.g., tooth 12) each attached to a respective shank using a respective flex pin 10. While FIG. 1 illustrates flex pin 10 installed in a vertical position in tooth 12 and shank 14 (e.g., where the central axis 16 of flex pin 10 is mounted in a direction substantially perpendicular to the digging edge of the bucket), in some examples, flex pin 10 may be installed in other configurations including, for example, a horizontal configuration (e.g., where the central axis 16 of flex pin 10 is mounted in a direction substantially parallel to the digging edge of the bucket).

Figure 2:
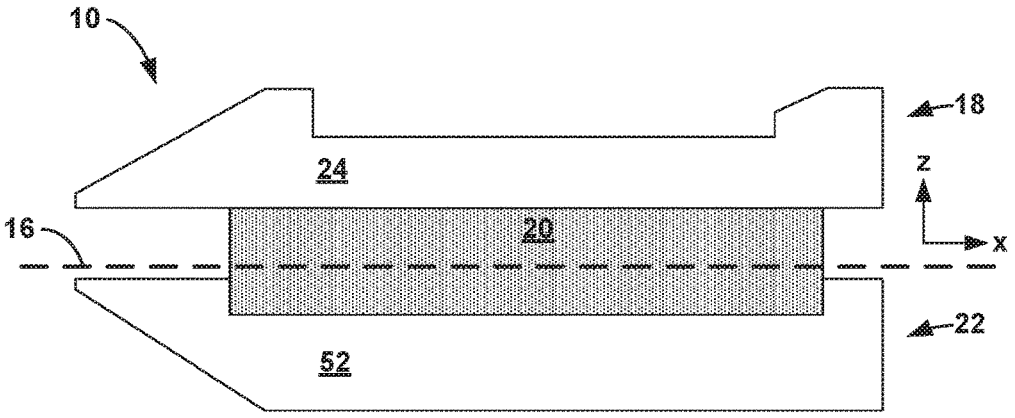
FIG. 2 is a conceptual side view schematic illustrating an example flex pin.
Figure 3:
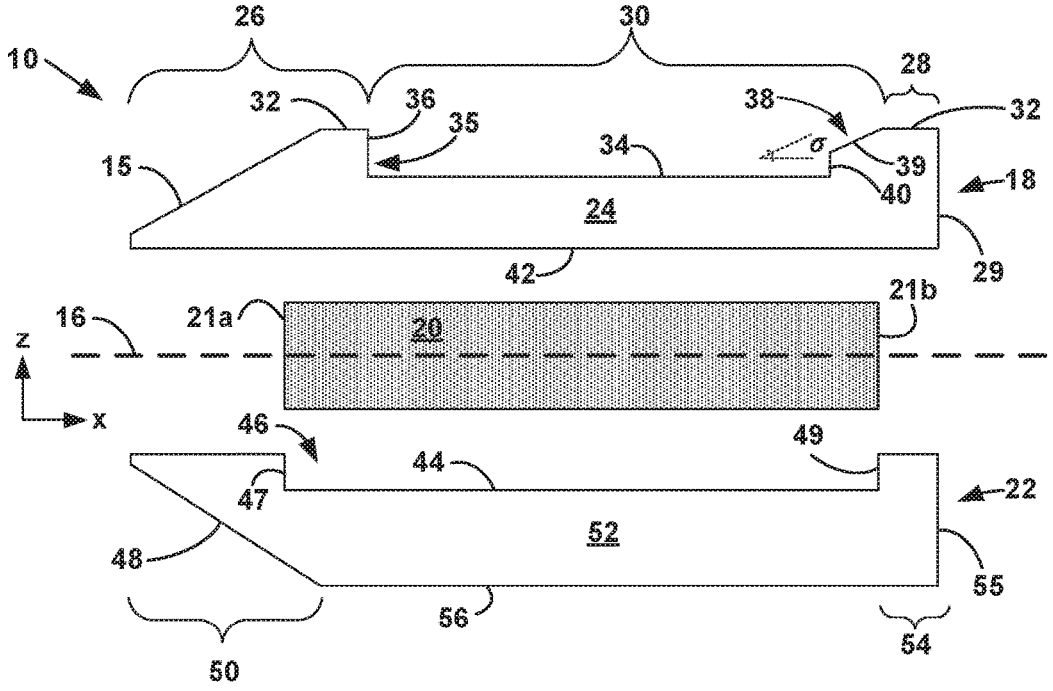
FIG. 3 is a conceptual side-exploded view schematic of the flex pin of FIG. 2.

FIGS. 2 and 3 are a conceptual side view (FIG. 2) and side-exploded view (FIG. 3) illustrating example flex pin 10. Flex pin 10 may include a first rigid member 18, a second rigid member 22, and a compressible member 20 positioned between and connected to the first and second rigid members 18 and 22. The assembled flex pin 10 may define a central axis 16 extending lengthwise through the flex pin (e.g., in the x-axis direction of FIG. 2) to define the major axis of flex pin 10.

In some examples, first rigid member 18 of flex pin 10 may include a first elongated body 24 that extends from a first forward end 26 to a first back end 28 along central axis 16. First elongated body 24 has a first outer surface 32 and a first bonding surface 42. First outer surface 32 may include a locking recess 30 that extends laterally along first elongated body 24 between first forward 26 and first back end 28 (e.g., in the x-axis direction of FIG. 2). In some examples, locking recess 30 may include a locking major surface 34 that is substantially parallel (e.g., parallel or nearly parallel) to central axis 16, locking major surface 34 being configured to contact a portion of shank 14 or tooth 12 when flex pin 10 is installed and seated in a "locked" position (e.g., FIG. 1). Locking recess 30 may include a forward portion 35, which includes a forward wall 36 that extends in the z-axis direction away from locking major surface 34. In some examples, forward wall 36 is substantially perpendicular (e.g., perpendicular or nearly perpendicular) to central axis 16 and positioned adjacent to first forward end 26. However, in other examples, forward wall 36 may define a different angle relative to central axis 16.

Locking recess 30 may also include a rear portion 38, which includes a back wall 40 (e.g., a step) that extends in the z-axis direction away from locking major surface 34 and a back gradient 39 defining a slope (σ) that transitions from the upper end of back wall 40 (e.g., the end of back wall 40 furthest from locking major surface 34 as measured in the z-axis direction) to first outer surface 32 such that back gradient 39 is positioned further from first bonding surface 42 than locking major surface 34 and first outer surface 32 is positioned further from first bonding surface 42 than back gradient 39 as measured in a direction perpendicular to the central axis. In some examples, back wall 40 is substantially perpendicular (e.g., perpendicular or nearly perpendicular) to the central axis 16. However, in other examples, back wall 40 may define a different angle relative to central axis 16. Back gradient 39 may define a continuous inclined surface (e.g., a planar surface, a curvilinear surface, or another continuous surface) that joins the upper end back wall 40 and first outer surface 32. The slope (σ) defined by back gradient 39 of rear portion 38 may be defined relative to central axis 16. In some examples, back gradient 39 may extend from locking major surface 34 to first outer surface 32 such that back wall 40 is not present.

In some examples, locking recess 30 may be configured to physically engage with tooth 12 and shank 14 when flex pin 10 is installed to secure flex pin 10 in bore holes 13 and help inhibit flex pin 10 from becoming unintentionally dislodged from bore holes 13 (e.g., ejecting during operation). For example, as shown in FIG. 1, when flex pin 10 may be inserted in bore holes 13 into a "locked" position where a portion of shank 14 may be received and seated in locking recess 30 such that the portion of shank 14 may contact locking major surface 34 and set between forward wall 36 and back wall 40. In some examples, the diameter of flex pin 10, as discussed further below, may be sized larger than bore holes 13 so that compressible member 20 remains slightly compressed when flex pin 10 is installed, thereby providing some retention force (e.g., force in the perpendicular a direction to central axis 16) to help retain the portion of shank 14 in locking recess 30 and to help inhibit flex pin 10 from becoming unintentionally dislodged from bore holes 13 (e.g., ejected in a direction parallel to central axis 16) during operation of the earthmoving vehicle.

In some examples, forward wall 36 and back wall 40 may be designed to help inhibit flex pin 10 from being unintentionally dislodged from bore holes 13 (e.g., ejecting during operation). For example, forward wall 36 and back wall 40 by be formed to be substantially perpendicular to central axis 16 (e.g., perpendicular or nearly perpendicular) to provide substantially perpendicular contact surfaces for receiving shank 14 that may inhibit the ability of shank 14 from becoming dislodged from locking recess 30 during operation (e.g., ejected in the x-axis direction of FIG. 2) compared to other designs where forward wall 36, back wall 40, or both may be tapered or sub-perpendicular (e.g., 60° to locking major surface 34 and central axis 16). Additionally or alternatively, the combination of back wall 40 and back gradient 39 may also providing high retention capabilities that inhibit the unintentional dislodgement of flex pin 10 from bore holes 13 during normal operation of the vehicle and use of the tooth 12 due to the combined design features of back wall 40 and the sloped surface of back gradient 39, which may force shank 14 to realign such that shank 14 sits against locking major surface 34 after shank 14 becomes partially dislodged from locking recess 30.

Second rigid member 22 of flex pin 10 may include a second elongated body 52 that extends along central axis 16 from a second forward end 50 to a second back end 54. Elongated body 52 may define a second outer surface 56 and a second bonding surface 44. In some examples, first outer surface 32 and second outer surface 56 may be curved (e.g., curved in a radial direction of central axis 16) such that flex pin 10 exhibits a semi-cylindrical (e.g., elliptical-cylindrical) shape configured to be inserted in bore holes 13 of tooth 12 and shank 14.

In some examples, first forward end 26 and second forward end 50 may define respective tapered tips 15 and 48. During the insertion of flex pin 10 into bore holes 13 during installation, tapered tips 15 and 48 may allow flex pin 10 to be slidably advanced into the "locked" position. In this way, tapered tips 15 and 48 may improve the ease with which flex pin 10 may be installed in bore holes 13.

In some examples, first back end 28 and second back end 54 may include a first driving surface 29 and a second driving surface 55 respectively. First and second driving surfaces 29 and 55 may be configured to provide a relatively blunt surface compared to tapered tips 15 and 48 that may be used to engage a tool that applies a driving force (e.g., press, hammer, punch, or the like) to insert flex pin 10 into bore holes 13. In some examples, first and second driving surfaces 29 and 55 may be substantially perpendicular (e.g., perpendicular or nearly perpendicular) to central axis 16.

First rigid member 18 and second rigid member 22 may be made using any suitable material sufficiently rigid so that first rigid member 18 and second rigid member 22 sufficiently retain their respective shapes during routine operation of the earthmoving vehicle. For example, first rigid member 18 and second rigid member 22 may be constructed to include a metal or metal alloy material including, for example, AISI 1045 carbon steel. In some examples, first rigid member 18 and second rigid member 22 may be formed by metal casting and/or machining techniques to form the various geometric features described herein. In some examples, the geometric features of rear portion 38 (e.g., back wall 40 and back gradient 39) may permit first rigid member 18 to be easily cast as compared to a rear portion 38 that include more complex transition features (e.g., multiple steps, walls, or gradients).

Compressible member 20 may be positioned between first rigid member 18 and second rigid member 22 such that compressible member 20 connects to first bonding surface 42 and second bonding surface 44. Compressible member 20 may include any suitable material configured to permit flex pin 10 to be compressed (e.g., in the z-axis direction of FIG. 2) and inserted in bore holes 13 while also allowing flex pin 10 to return to a non-compressed or semi-compressed state once flex pin 10 is inserted and seated in the "locked" position in bore holes 13 (e.g., FIG. 1). In some examples, compressible member 20 may include one or more resilient polymer materials including, for example, specially formulated rubbers such as styrene-butadiene rubber (SBR).

In some examples first bonding surface 42 and second bonding surface 44 may be substantially planar (e.g., planar or nearly planar) and positioned substantially parallel (e.g. parallel or nearly parallel) to one another to receive compressible member 20. In some examples, second bonding surface 44 defines bonding recess 46 configured to receive part of compressible member 20. Bonding recess 46 may be rectangular shaped in cross-section (or another suitable shape) and include front and rear retaining walls 47 and 49, respectively. The front and rear retaining walls 47 and 49 may be positioned substantially perpendicular (e.g., perpendicular or nearly perpendicular) to central axis 16 and substantially parallel (e.g., parallel or nearly parallel) to one another. Bonding recess 46 and compressible member 20 may be sized such that compressible member 20 may be positioned in bonding recess 46 between front and rear retaining walls 47 and 49.

In some examples, front and rear retaining walls 47 and 49 may inhibit lateral movement (e.g., movement along central axis 16) of compressible member 20. Such configurations may help inhibit flex pin 10 from becoming unintentionally dislodged during operation. For example, as flex pin 10 becomes compressed in the z-axis direction of FIG. 2, compressible member 20 may be elastically deformed such that compressible member budges or protrudes laterally (e.g., expand parallel to central axis 16), causing the tensile strength of compressible member 20 to be diminished. The presence of front and rear retaining walls 47 and 49 may inhibit the deformation of compressible member 20, which may increase the resilience (e.g., tensile strength) of compressible member 20 and help to retain flex pin 10 in the "locked" position in bore holes 13 (e.g., FIG. 1) while still permitting some degree of deformation of compressible member 20 (e.g., in the z-axis direction of FIG. 2) during the installation and removal of flex pin 10 (e.g., FIGS. 6A, 6C, and 6C). In some such examples, compressible member 20 may define a box-shape (e.g., shaped like a box apart from logos, aligners, molding imperfections, or the like) such that compressible member 20 includes a front end 21*a* and a back end 21*b* and defines a major length (e.g., parallel to central axis 16) that is substantially equal (e.g., equal or nearly equal) to the distance between front and rear retaining walls 47 and 49 to allow a portion of compressible member 20 to be received in bonding recess 46.

Figure 4:
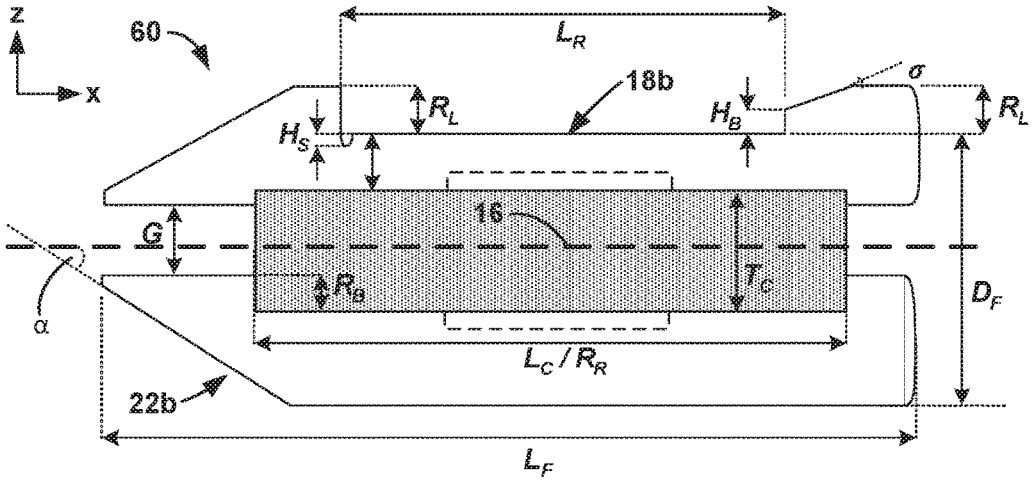
FIG. 4 is a conceptual side view schematic illustrating another example flex pin.
Figure 5:
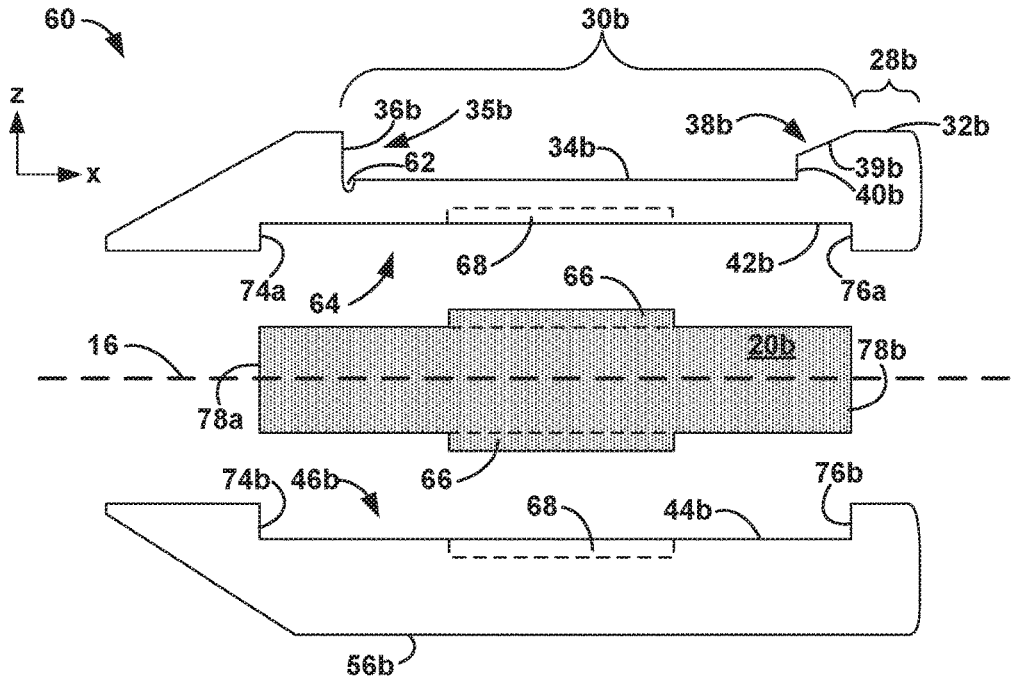
FIG. 5 is a conceptual side-exploded view schematic of the flex pin of FIG. 4.

While bonding recess 46 is depicted as being incorporated as part of second rigid member 22 of FIG. 2, in some examples bonding recess 46 may be incorporated in first rigid member 18 or both first rigid member 18 and second rigid member 22. For example, FIGS. 4 and 5 illustrate a conceptual side view (FIG. 4) and side-exploded view (FIG. 5) of another example flex pin 60. As shown in FIG. 5, flex pin 60 of includes a first bonding surface 42*b* that includes a first bonding recess 64 and includes a second bonding surface 44*b* that includes a second bonding recess 46*b*. Each bonding recess 46*b*, 64 may define a front retaining wall 74*a*, 74*b* and a rear retaining wall 76*a*, 76*b* extending away from the respective bonding surfaces 42*b*, 44*b*, such as, but not limited to, in a direction substantially perpendicular to central axis 16, configured to receive a respective portion of compressible member 20*b*. For example, compressible member 20*b* may define a box shape (e.g., rectangular in cross-section, the cross-section taken along a central longitudinal axis) having a front end 78*a*, and back end 78*b* which get retained between the respective front retaining walls 74*a*, 74*b* and rear retaining walls 76*a*, 76*b* of first and second bonding recess 46*b*, 64. The inclusion of first bonding recess 64 and second bonding recess 46*b* may provide increased resistance against lateral deformation (e.g., along the x-axis of FIG. 4) of compressible member 20*b*, which may help inhibit flex pin 60 from becoming unintentionally dislodged from during operation of the earthmoving vehicle.

In some examples, as shown in FIGS. 4 and 5, first bonding surface 42*b* and second bonding surface 44*b* may each include one or more optional alignment recesses 68 configured to receive a corresponding alignment guide 66 of compressible member 20*b*. In some examples, the alignment guides 66 may be configured to help align and/or attach compressible member 20*b* to first bonding surface 42*b* and second bonding surface 44*b* during assembly of flex pin 60. In other examples, compressible member 20*b*, first bonding surface 42*b*, and second bonding surface 44*b* may exclude the presence of alignment guide 66 and alignment recesses 68 such that compressible member 20*b* is similar to compressible member 20 of FIGS. 2 and 3. Flex pin 60 includes a locking recess 30*b* defined by a forward portion 35*b* that includes a forward wall 36*b*, a locking major surface 34*b*, and rear portion 38*b* that includes a back wall 40*b* and a back gradient 39*b* that defines a slope (σ) extending between the upper end of back wall 40*b* and first outer surface 32*b*. Forward and back walls 36*b*, 40*b* extend away from locking major surface 34*b* in a z-axis direction at any suitable angle. For example, forward and back walls 36*b*, 40*b* may be positioned substantially perpendicular to locking major surface 34*b* (e.g., perpendicular or nearly perpendicular).

In some examples, flex pin 60 further defines a slot 62 abutting and separating forward wall 36*b* and locking major surface 34*b*. The inclusion of slot 62 may help ensure that forward wall 36*b* maintains a substantially perpendicular contact surface (e.g., perpendicular or nearly perpendicular to central axis 16) for receiving shank 14. For example, in some examples that do not include slot 62 (e.g., flex pin 10), debris or other materials (e.g., excess cast material used to form first rigid member 18) may accumulate at the junction between forward wall 36*b* and locking major surface 34*b*. When such flex pins are installed on the earthmoving vehicle, the accumulated debris or other materials may prevent shaft 14 from properly seating or "locking" in locking recess 30*b*. In some examples, the accumulated debris or other materials may increase the likelihood of the flex pin becoming unintentionally dislodged from bore holes 13 during operation. The inclusion of slot 62 may help reduce the affect any accumulation of debris or other materials at the junction between forward wall 36*b* and locking major surface 34*b* may have on the desired geometry of the junction, which may help inhibit flex pin 60 from becoming unintentionally dislodged during operation.

Rear portion 38*b* includes back wall 40*b* and back gradient 39*b*. Back wall 40*b* may extend from locking major surface 34*b* to allow a portion of a shank (e.g., shank 14 of FIG. 1) to be received and seated in locking recess 30*b* such that the portion of shank 14 may contact locking major surface 34*b* and set between forward wall 36*b* and back wall 40*b*. In some examples, back wall 40*b* extends substantially perpendicular (e.g., perpendicular or nearly perpendicular) to locking major surface 34*b*. The substantially perpendicular orientation of forward and back walls 36*b*, 40*b* may inhibit the ability of flex pin 60 from becoming unintentionally dislodged during operation of the tooth and shank assembly. For example, the substantially perpendicular orientation of forward and back walls 36*b*, 40*b* may permit some degree of compressibility of flex pin 60 during operation (e.g., compression of flex pin 60 in the z-axis direction of FIG. 4) without permitting movement of the flex pin along central axis 16 while the flex pin in set in the "locked" position within the tooth and bucket assembly. In some examples, back wall 40*b* may define a height ($H_B$) equal to or less than the approximate midpoint between locking major surface 38*b* and first outer surface 32*b* (e.g., equal to or less than half the locking recess height ($R_L$)).

Back portion 38*b* also includes back gradient 39*b* that defines a slope (σ) extending between back wall 40*b* and first outer surface 32*b*. In some examples as described further below, back gradient 39*b* may enable convenient removal of flex pin 60 from bore holes 13 (FIG. 1) to facilitate the replacement of a worn tooth (e.g., tooth 12 of FIG. 1) by, for example, allowing flex pin 60 to be removed from bore holes 13 using a press. Additionally or alternatively, back gradient 39*b* may inhibit the ability of flex pin 60 from becoming unintentionally dislodged during operation of the tooth and shank assembly. For example, while back wall 40*b* provides a first degree of protection against unintentional dislodgement of flex pin 60, in some examples the portion of shank 14 received within the locking recess 30*b* may unseat and rest on a portion of back gradient 39*b*. In such examples, the slope (σ) of back gradient 39*b* and compression force supplied by compressible member 20*b* may force shank 14 back down the gradient 39*b* towards locking major surface 34*b* to be received again by locking recess 30*b*.

Back gradient 39*b* may define any suitable slope (σ). In some examples, the slope (σ) may be less than or equal to about 80 degrees as measured from (e.g., relative to) central axis 16, such as less than or equal to about 45 degrees as measured from central axis 16, or about 10 degrees to about 60 degrees as measured from central axis 16.

In some examples, back gradient 39*b* may define a substantially planar surface (e.g., planar or nearly planar) that lies parallel with the y-axis of FIG. 5 and extents from an upper end of back wall 40*b* (e.g., the end of back wall 40*b* furthest from locking major surface 34 as measured in the z-axis direction) to first outer surface 32*b*. In other examples, back gradient 39*b* may define a curvilinear surface (e.g., partially conical) as back gradient 39*b* extends from an upper end of back wall 40*b* to the outer perimeter defined by first rigid member 18*b* (e.g., first outer surface 32*b* as well as the respective sides of first rigid member 18*b* (not labeled)). In such examples, the associated descriptions of the slope (σ), upper end of back wall 40, back wall height ($H_B$), locking recess depth ($R_L$), and the like may be characterized in reference to central axis 16 along a plane (e.g., x-y plane of FIG. 4) that evenly bisects each of first rigid member 18*b*, second rigid member 22*b*, and compressible member 20*b*.

FIG. 4 also includes various dimensional parameters that may be used to describe flex pin 60 including for example, a flex pin length ($L_F$) that indicates a length from one end of flex pin 60 to another (e.g., about 2.2 inches), a locking recess depth ($R_L$) that indicates the depth of a locking recess 30*b* (e.g., about 0.07 inches), a bonding recess depth ($R_B$) that indicates the depth of a bonding recess defined by one of the rigid members (e.g., about 0.08 inches or less), a tapered tip angle (α) (e.g., about 36°), a locking recess seat length ($L_R$) that is measured between forward wall 36*b* and back wall 40*b* (e.g., about 1.2 to about 1.5 inches), a back wall height ($H_B$) that indicates the z-axis distance between major surface 34*b* and an upper end of back wall 40*b* where an end of back gradient 39*b* begins (e.g., about 0.03 inches), a gap distance (G) defining the separation distance between first rigid member 18*b* and second rigid member 22*b* when compressible member 20*b* is in a non-compressed state (e.g., as measured perpendicular to central axis 16 in the z-axis direction) (e.g., about 0.2 inches), a flex pin diameter ($D_F$) that defines the perpendicular (relative to central axis 16) distance between locking major surface 34*b* and second outer surface 56*b* (e.g., about 0.7 inches) when compressible member 20 is at a rest state and not compressed by external forces, a slot depth ($H_S$) (e.g., about 0.02 inches), a length ($L_C$) of compressible member 20*b* (e.g., about 1.6 inches to about 1.9 inches), a length ($R_R$) between the respective front and rear retaining walls 74*a*, 74*b*, 76*a*, 76*b* (e.g., about 1.6 inches to about 1.9 inches), and a thickness of compressible member 20 ($T_C$) as measured perpendicular to central axis 16 in the z-axis direction (e.g., about 0.3 inches). Although referred to as a flex pin diameter ($D_F$), flex pins described herein may not be circular in cross-section (taken perpendicular to central axis 16), such that flex pin diameter ($D_F$) may generally indicate a dimension measured in the z-axis direction of FIG. 4.

Figure 6A:
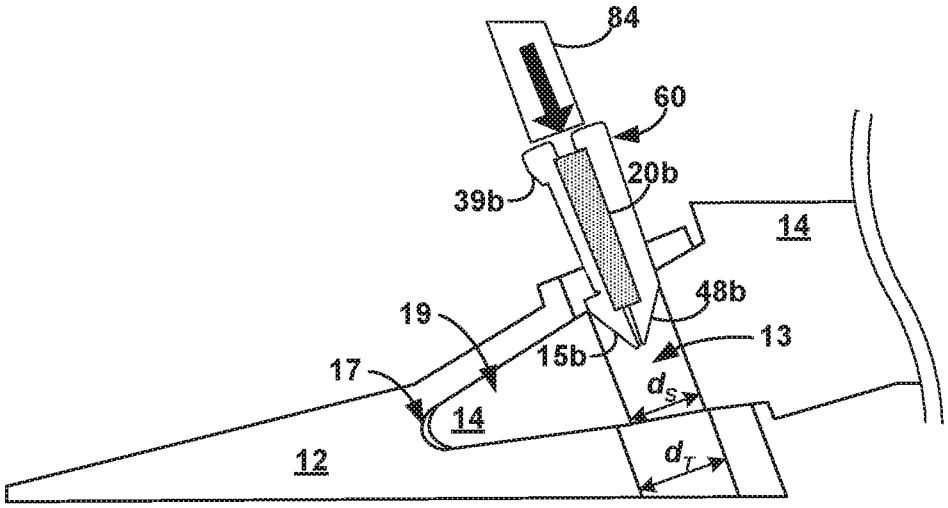
FIGS. 6A-6D are conceptual side views of another assembly illustrating an example flex pin being installed and removed from the tooth and shank assembly.

In some examples, the various dimensional parameters of flex pin 60 may be selected depending on the diameter of bore holes 13 in which flex pin 60 is installed. For example, as shown in FIG. 6A, shank 14 defines a shank bore hole having a diameter ($d_S$) measured at the portion of shank 14 received by the locking recess 30*b* when the flex pin 60 is installed in the "locked" position (e.g., FIGS. 1 and 6B). In some examples, tooth 14 may define a tooth bore hole having a slightly larger diameter ($d_T$) compared to the shank bore hole diameter ($d_S$). In some examples, flex pin 60 may be constructed to define a flex pin diameter ($D_F$) of about 7% to about 8% larger than the shank bore hole diameter ($d_S$) and a gap distance (G) of about 30% of the shank bore hole diameter ($d_S$). In some examples, flex pin 60 may define a locking recess depth ($R_L$) equal to about 10% of the flex pin diameter ($D_F$), a bonding recess depth ($R_B$) of about 12% of the flex pin diameter ($D_F$), a thickness for compressible member 20 ($T_C$) of about 14%, a back wall height ($H_B$) of equal to or less than half the locking recess depth ($R_L$) (e.g., the height of back wall 40*b* is less than or equal to a half of the distance between first outer surface 32*b* and locking major surface 34*b* as measured in a direction perpendicular to central axis 16 within the x-y plane that evenly bisects flex pin 60), and/or a slot depth ($H_S$) of about 25% of locking recess depth ($R_L$). In some examples, locking recess seat length ($L_R$) may be sized to substantially equal (e.g., equal, nearly equal, or slightly larger) to the portion of shank 14 received by locking recess 30*b* and the overall thickness of flex pin 60 (e.g., locking recess depth ($R_L$) plus flex pin diameter ($D_F$)) may be sized to be substantially equal to (e.g., equal, nearly equal, or slightly larger) or larger than the tooth bore hole diameter ($d_T$). Additionally or alternatively, the length ($L_C$) of compressible member 20*b* and the length ($R_R$) between the respective front and rear retaining walls 74*a*, 74*b*, 76*a*, 76*b* may be substantially equal (e.g., equal or nearly equal).

Figure 6B:
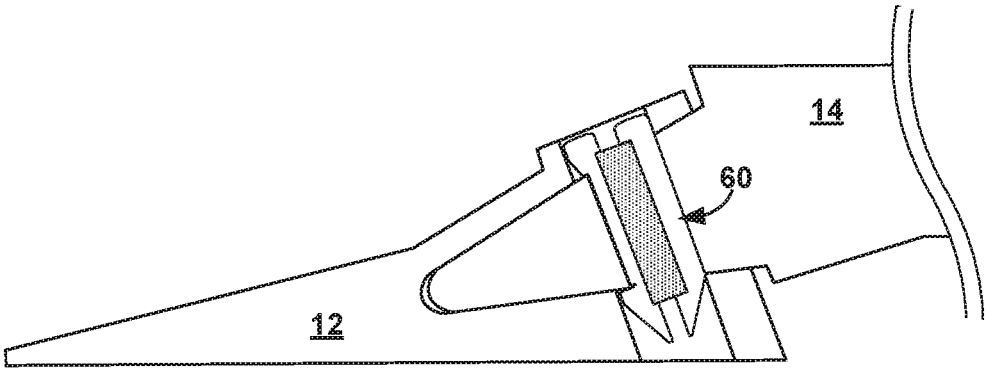

FIGS. 6A-6D illustrate a conceptual progression of a flex pin 60 being installed and removed from a tooth 12 and shank 14 assembly. For example, FIG. 6A illustrates flex pin 60 being driven into substantially aligned bore holes 13 of tooth 12 and shank 14 and FIG. 6B illustrates flex pin 60 in an installed (e.g., "locked") position within bore holes 13. As flex pin 60 is inserted, tapered tips 15*b* and 48*b* contact portions of tooth 12 and/or shank 14 and allow for the gradual compression of compressible member 20*b* as flex pin 60 is advanced into the "locked" position (FIG. 6B). Because tapered tips 15*b* and 48*b* define an outer dimension that increases in a direction away from tooth 12 and shank 14 as flex pin 60 is being installed in bore holes 13, tapered tips 15*b* and 48*b* may be configured to facilitate the introduction of flex pin 60 into misaligned bore holes 13, which may define a smaller opening for receiving flex pin 60. Tapered tips 15*b* and 48*b* may help align bore holes 13 of tooth and shank 14 as flex pin 60 is moved into bore holes 13 if bore holes 13 are misaligned prior to introduction of flex pin 60. Thus, in some examples, tapered tips 15*b* and 48*b* may help improve the ease with which flex pin 60 is installed into bore holes 13.

In some examples, the inclusion of tapered tips 15*b* and 48*b* may permit flex pin 60 to be installed using a press 84 (e.g., hydraulic or mechanical press). In such examples, the tapered tip angle ($\alpha$) may be about 40° to allow for easier advancement of flex pin 60 into the "locked" position (FIG. 6B).

Figure 6C:
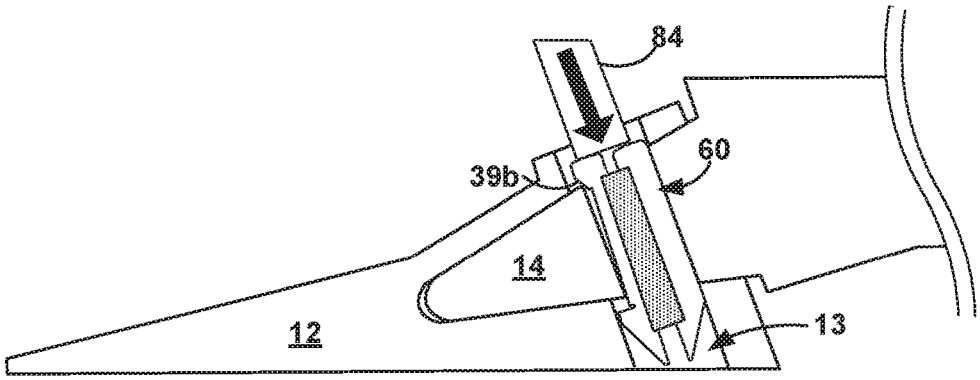
Figure 6D:
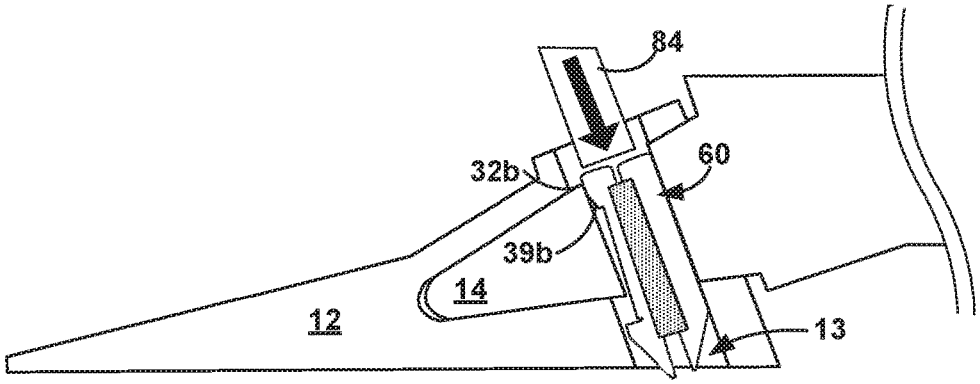

Flex pin 60 may be removed from bore holes 13 by continuing the advancement of flex pin 60 in the direction in which it was installed (FIGS. 6C and 6D). FIG. 6C shows the portion of shank 14 received by flex pin 60 being unseated from locking major surface 34*b* such that shank 14 transitions over back wall 40*b* and advances across back gradient 39*b* of rear portion 38*b* of flex pin 60. The intersection between back wall 40*b* and back gradient 39*b* defines a smaller outer diameter of flex pin 60 compared to the outer diameter defined by at first outer surface 32*b*. The small outer diameter means that less compression force is needed for shank 14 to overcome the height of back wall 40*b* compared to a flex pin that has a continuous back wall extending from locking major surface 34*b* to first outer surface 32*b*. FIG. 6D shows the continued advancement of flex pin 60 such that the portion of shank 14 received by flex pin 60 is advanced across back gradient 39*b* to rest on first outer surface 32*b*. The combination of back wall and back gradient 39*b* may allow for easier advancement of flex pin 60 through bore holes 13 in order to remove flex pin 60 from bore holes 13 due to the sloped surface of back gradient 39*b*, while also providing high retention capabilities to inhibit the unintentional dislodgement of flex pin 60 during normal operation.

Figure 7:
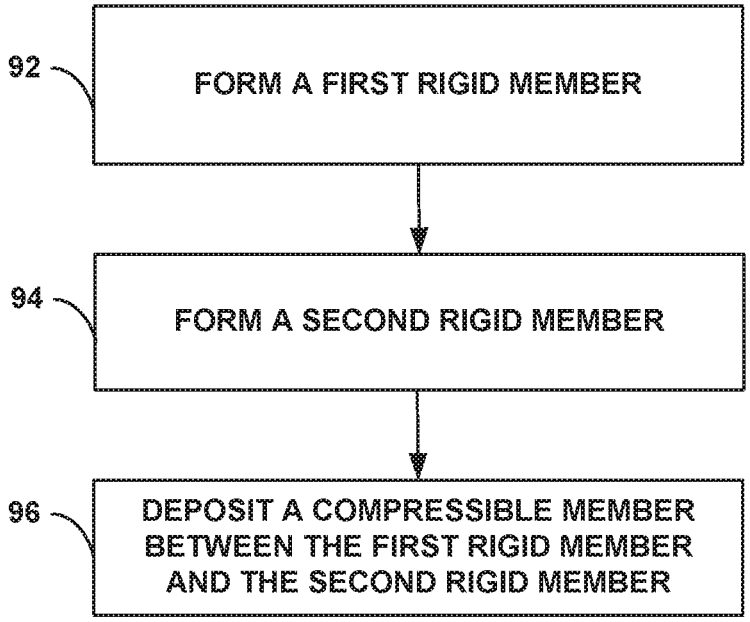
FIG. 7 is a flow diagram illustrating an example technique for forming an example flex pin.

Flex pin 60 may be formed using any suitable technique. FIG. 7 is a flow diagram illustrating an example technique for forming an example flex pin in accordance with the disclosure, such as, for example flex pin 60. While the technique shown in FIG. 7 is described with respect to flex pin 60, in other examples, the techniques may be used to form other flex pins or portions of flex pins that include different configurations or the flex pins or portions of flex pins described herein may be formed using techniques other than those described in FIG. 7.

The technique illustrated in FIG. 7 includes forming a first rigid member 18*b* (92). As described above, first rigid member 18*b* may be constructed to include a metal or metal alloy material including, for example, AISI 1045 carbon steel. First rigid member 18*b* may be formed using any suitable technique to define one or more of the various geometrical features described above including, for example, metal casting, machining, or the like.

The technique illustrated in FIG. 7 also includes forming a second rigid member 22*b* (94). Second rigid member 22*b* may be constructed to include a metal or metal alloy material including, for example, AISI 1045 carbon steel. Second rigid member 22*b* may be formed using any suitable technique to define one or more of the various geometrical features described above including, for example, metal casting, machining, or the like. In some examples, first and second rigid members 18*b* and 22*b* may be formed using the same or different techniques and may be formed from the same or different materials.

The technique illustrated in FIG. 7 includes positioning a compressible member 20*b* between first and second rigid members 18*b* and 22*b* (96). Compressible member 20*b* may include any suitable material(s) configured to permit flex pin 60 to be compressed and subsequently to return to its non-compressed state. In some examples, compressible member 20*b* may include one or more resilient polymer materials including, for example, specially formulated rubbers such as styrene-butadiene rubber (SBR). In some examples, compressible member 20*b* may be positioned between first and second rigid members 18*b* and 22*b* (96) using a rubber vulcanization process in which first and second rigid members 18*b* and 22*b* are positioned adjacent with first and second bonding surfaces 42*b* and 44*b* facing and parallel to one another in a prepared mold. A resilient rubber (e.g., SBR) may then be deposited and hardened in the adjoining space between bonding surfaces 42*b* and 44*b*. In other examples, compressible member 20*b* may be formed separately using a mold and connected to bonding surfaces 42*b* and 44*b* using a suitable adhesive.

In some examples, compressible member 20*b* may define a box-shape having a front end 78*a* and back end 78*b* that are retained between a respective front retaining wall 74*a*, 74*b* and rear retaining wall 76*a*, 76*b* of bonding recess 46*b*, 64 defined in the first bonding surface 42*b*, the second bonding surface 44*b*, or both.

In some examples herein, a flex pin, e.g., flex pin 10 or 60, may include directional markers on the flex pin, the directional markers indicating the front and rear faces of the respective flex pin to assist the operator with the proper installation of the flex pin. The markers can be printed, formed within, or otherwise on the flex pin and visible to an operator.

Various examples of the disclosure have been described. These and other examples are within the scope of the following claims.

What is claimed is:

1. A flex pin comprising:

a first rigid member comprising a first elongated body extending along a central axis of the flex pin from a first forward end to a first back end, wherein the first elongated body defines a first bonding surface and a locking recess, wherein the locking recess extends laterally along the first elongated body between the first forward end and the first back end, the locking recess comprising:

a major surface, a forward portion comprising a forward wall adjacent to the first forward end, and a rear portion comprising a back wall extending from the major surface of the locking recess, and a back gradient defining a slope that transitions from an end of the back wall to a first outer surface of the first rigid member, wherein the first forward end defines a first tapered tip;

a second rigid member comprising a second elongated body extending along the central axis from a second forward end to a second back end, wherein the second elongated body defines a second outer surface and a second bonding surface, wherein the second forward end defines a second tapered tip; and a compressible member positioned between the first rigid member and the second rigid member, wherein the compressible member is connected to the first bonding surface and the second bonding surface, wherein at least one of the first bonding surface or the second bonding surface defines a bonding recess configured to receive a portion of the compressible member, and wherein the first forward end of the first rigid member and the second forward end of the second rigid member define a forward-most tip of the flex pin.

2. The flex pin of claim 1, wherein the locking recess defines a slot between the forward wall and the major surface of the locking recess.

3. The flex pin of claim 1, wherein the slope of the back gradient defines an angle less than about 45 degrees relative to the central axis, and wherein the forward wall and the back wall are substantially perpendicular to the central axis.

4. The flex pin of claim 1, wherein the major surface of the locking recess is substantially parallel to the central axis, wherein the first outer surface and the major surface of the locking recess are separated by a first distance as measured in a direction perpendicular to the central axis, wherein the back wall extends from the major surface of the locking recess by a second distance as measured in a direction perpendicular to the central axis, and wherein the second distance is less than or equal to a half of the first distance.

5. The flex pin of claim 1, wherein the first bonding surface defines a first bonding recess configured to receive a first portion of the compressible member, and wherein the second bonding surface defines a second bonding recess configured to receive a second portion of the compressible member.

6. The flex pin of claim 5, wherein the first and second bonding recesses each define a front retaining wall substantially perpendicular to the central axis and a rear retaining wall substantially perpendicular to the central axis, wherein the compressible member defines a rectangular shaped cross-section configured to be received between the front retaining walls and the rear retaining walls.

7. The flex pin of claim 1, wherein the first back end defines a first driving surface substantially perpendicular to the central axis, wherein the second back end defines a second driving surface substantially perpendicular to the central axis, and wherein the first driving surface and the second driving surface define an end of the flex pin.

8. The flex pin of claim 1, wherein the compressible member comprises styrene-butadiene.

9. The flex pin of claim 1, wherein the first rigid member and the second rigid member comprise AISI 1045 carbon steel.

10. The flex pin of claim 1, wherein the first bonding surface is substantially parallel to the second bonding surface.

11. A method of forming a flex pin, the method comprising:

forming a first rigid member, wherein the first rigid member comprises a first elongated body extending along a central axis of the flex pin from a first forward end to a first back end, wherein the first elongated body defines a first bonding surface and a locking recess, wherein the locking recess extends laterally along the first elongated body between the first forward end and the first back end, the locking recess comprising:

a major surface, a forward portion comprising a forward wall adjacent to the first forward end, and a rear portion comprising a back wall extending from the major surface of the locking recess and a back gradient defining a slope that transitions from an end of the back wall to a first outer surface of the first rigid member, wherein the first forward end defines a first tapered tip;

forming a second rigid member, wherein the second rigid member comprises a second elongated body extending along the central axis from a second forward end to a second back end, wherein the second elongated body defines a second outer surface and a second bonding surface, wherein the second forward end defines a second tapered tip; and positioning a compressible member between the first rigid member and the second rigid member, wherein positioning the compressible member comprises positioning a portion of the compressible member into a bonding recess defined by at least one of the first bonding surface or the second bonding surface, wherein the compressible member is connected to the first bonding surface and the second bonding surface, and wherein the first forward end of the first rigid member and the second forward end of the second rigid member define a forward-most tip of the flex pin.

12. The method of claim 11, wherein forming the first rigid member comprises casting a molten metal to form the first rigid member.

13. The method of claim 11, wherein positioning the compressible member between the first rigid member and the second rigid member comprises:

forming the compressible member using a mold, wherein the compressible member comprises styrene-butadiene; and adhering the compressible member to the first bonding surface and the second bonding surface using an adhesive.

14. The method of claim 11, wherein the locking recess defines a slot between the forward wall and the major surface of the locking recess.

15. The method of claim 11, wherein the slope of the back gradient defines an angle less than about 45 degrees as measured relative to the central axis, and wherein the forward wall and the back wall are substantially perpendicular to the central axis.

16. The method of claim 15, wherein the major surface of the locking recess is substantially parallel to the central axis, wherein the first outer surface and the major surface of the locking recess are separated by a first distance as measured in a direction perpendicular to the central axis, wherein the back wall extends from the major surface of the locking recess by a second distance as measured in a direction perpendicular to the central axis, and wherein the second distance is less than or equal to a half of the first distance.

17. The method of claim 11, wherein the first back end defines a first driving surface substantially perpendicular to the central axis, wherein the second back end defines a second driving surface substantially perpendicular to the central axis, and wherein the first driving surface and the second driving surface define an end of the flex pin.

18. The method of claim 11, wherein the bonding recess is defined by the second bonding surface, wherein the bonding recess comprises a front retaining wall substantially perpendicular to the central axis and a rear retaining wall substantially perpendicular to the central axis, wherein the compressible member defines a box-shape configured to be received between the front retaining wall and the rear retaining wall.

19. The method of claim 11, wherein positioning a portion of the compressible member into the bonding recess defined by at least one of the first bonding surface or the second bonding comprises:

positioning a first portion of the compressible member into a first bonding recess defined by the first bonding surface, wherein the first bonding recess comprises a first front retaining wall substantially perpendicular to the central axis and a first rear retaining wall substantially perpendicular to the central axis; and positioning a second portion of the compressible member into a second bonding recess defined by the second bonding surface, wherein the second bonding recess comprises a second front retaining wall substantially perpendicular to the central axis and a second rear retaining wall substantially perpendicular to the central axis.

20. The method of claim 11, wherein the first rigid member and the second rigid member comprise AISI 1045 carbon steel.

21. A flex pin comprising:

a first rigid member comprising a first elongated body extending along a central axis of the flex pin from a first forward end to a first back end, wherein the first elongated body defines a first bonding surface and a locking recess, wherein the locking recess extends laterally along the first elongated body between the first forward end and the first back end, the locking recess comprising:

a major surface, a forward portion comprising a forward wall adjacent to the first forward end, and a rear portion comprising a back wall extending from the major surface of the locking recess, and a back gradient defining a slope that transitions from an end of the back wall to a first outer surface of the first rigid member, wherein the first forward end defines a first tapered tip;

a second rigid member comprising a second elongated body extending along the central axis from a second forward end to a second back end, wherein the second elongated body defines a second outer surface and a second bonding surface, wherein the second forward end defines a second tapered tip; and a compressible member positioned between the first rigid member and the second rigid member, wherein the compressible member is connected to the first bonding surface and the second bonding surface, wherein at least one of the first bonding surface or the second bonding surface defines a bonding recess configured to receive a portion of the compressible member, and wherein the first back end defines a first driving surface substantially perpendicular to the central axis, wherein the second back end defines a second driving surface substantially perpendicular to the central axis, and wherein the first driving surface and the second driving surface define an end of the flex pin.

* * * * *